United States Patent [19]

Hung

[11] Patent Number: 5,051,280

[45] Date of Patent: Sep. 24, 1991

[54] LOW TEMPERATURE SYNTHESIS OF ALKALI METAL NIOBATES AND TANTALATES

[75] Inventor: Yann Hung, Rochester, N.Y.

[73] Assignee: Eastman Kodak Company, Rochester, N.Y.

[21] Appl. No.: 591,307

[22] Filed: Oct. 1, 1990

[51] Int. Cl.[5] ..... B05D 3/02; G01G 33/00; G01G 35/00

[52] U.S. Cl. ..... 427/226; 423/593; 423/641; 427/165; 427/162

[58] Field of Search ..... 427/165, 162, 226; 423/593, 641

[56] References Cited

U.S. PATENT DOCUMENTS

| | | | |
|---|---|---|---|
| 3,619,235 | 11/1971 | Furuchi et al. | 427/226 |
| 4,037,005 | 7/1977 | Phillips | 427/162 |
| 4,108,970 | 8/1978 | Ballman et al. | 423/593 |
| 4,234,557 | 11/1980 | Arendt et al. | 423/593 |
| 4,332,579 | 6/1982 | Pastor et al. | 427/165 |
| 4,544,176 | 11/1985 | Asano et al. | 427/226 |

FOREIGN PATENT DOCUMENTS 63-270397 11/1988 Japan .

*Primary Examiner*—Janyce Bell
*Attorney, Agent, or Firm*—J. Jeffrey Hawley

[57] ABSTRACT

A new synthetic method for the production of alkali metal niobates and tantalates is disclosed. The method involves the pyrolysis of a stoichiometric salt of an alkali metal and a niobium or tantalum complex of a bidentate or tridentate ligand. These salts are stable and, since the alkali metal and the niobioum or tantalum are already present in stoichiometric amounts, the resulting material comprises a substantially pure alkali metal niobate or tantalate.

5 Claims, No Drawings

LOW TEMPERATURE SYNTHESIS OF ALKALI METAL NIOBATES AND TANTALATES

FIELD OF THE INVENTION

The present invention relates to a method for the production of alkali metal niobates or tantalates. These materials are useful in the preparation of optical layers useful as wave guides.

Description Relative to the Prior Art

Alkali metal niobates and tantalates, particularly lithium niobate, are well known materials for the formation of optical devices. These materials can be formed into layers which serve as optical waveguides. These materials can be used in electro-, acousto- and magneto-optic devices.

Formation of these layers has been difficult. In a typical method, lithium and niobium oxide powders are carefully mixed. However, it is difficult to obtain an exact 1:1 mixture and there are additional difficulties in that there is always some non homogeneity in mixed powders. These mixed powders are then coated on a support and fired at about 1000° C. to produce the desired layer. See for example U.S. Pat. Nos. 4,234,557 and 4,108,970 for processes of this type.

In Japanese KOKAI J63/3270379 there is disclosed an alternative method for the production of these layers. Lithium ethoxide and niobium pentaethoxide are mixed so that the molecular ratio is 1:1. This mixture is then refluxed to prepare a composite intermediate alkoxide. This alkoxide is then partially hydrolysed to prepare the niobate precursor. A solution of the precursor is applied to the substrate and fired at 400° C. to produce the desired layer. Again, as with powder mixing, it is difficult to obtain exactly a 1:1 molecular ratio. In addition, the starting ethoxide compounds are unstable and they break down to produce a number of undesired impurities. Furthermore, these compounds with monodentate ligands are all moisture sensitive.

Thus, there continues to be a need for a method for producing alkali metal niobates or tantalates and layers containing these niobates or tantalates wherein the method produces the desired 1:1 alkali metal: niobium or tantalum molecular ratio.

SUMMARY OF THE INVENTION

In accordance with the present invention, there is provided a method for making an alkali metal niobate or tantalate, said method comprising the steps of:

a) forming a salt of an alkali metal and a monovalent niobium or tantalum containing complex, said complex comprising niobium or tantalum complexed with three bidentate ligands or two tridentate ligands; and b) pyrolyzing said salt so as to form said alkali metal niobate or tantalate.

(Hereinafter, the salt of an alkali metal and a monovalent niobium or tantalum containing complex, wherein the niobium or tantalum is complexed with three bidentate ligands or two tridentate ligands, will be referred to as the alkaline metal niobium or tantalum complex.)

The method of the present invention has many advantages. The alkaline metal niobium or tantalum complex is very stable and can be stored for a long time before use. Most importantly however, the chemical structure of the alkaline metal niobium or tantalum complex insures that a 1:1 stoichiometric ratio of alkali metal and niobium or tantalum is maintained.

DETAILED DESCRIPTION OF THE INVENTION

In accordance with the invention, specific alkaline metal niobium or tantalum complexes are pyrolyzed to form the desired niobate or tantalate. The niobium or tantalum complexes have a single negative charge since niobium or tantalum is present in the +5 state and there are three bidentate ligands or two tridentate ligands present for a total negative charge of −6. The alkali metal is present in the salt in the +1 state. Thus, the 1:1 ratio of niobium or tantalum to alkali metal is preserved.

The niobium or tantalum can be complexed with any bidentate or tridentate ligand or mixture of ligands. Useful ligands can be derived from simple compounds such as derivatives of ethylene glycol as follows:

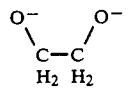

Derivatives of other glycols such as propane-1,2-diol; propane-1,3-diol; butane-2,3-diol; butane-1,4- diol; and pentane-1,5 diol are also useful.

Other bidentate ligands can be derivatives of hydroxycarboxylic acids such as lactic acid, mandelic acid and salicylic acid.

A useful tridentate ligand is, for example, a derivative of triethanolamine.

Other useful bidentate ligands, as described more completely below, include:

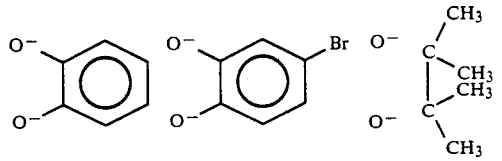

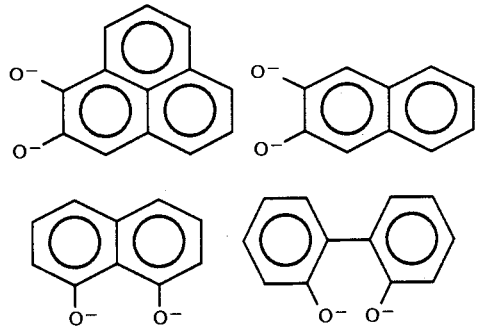

In accordance with preferred embodiments of the invention, the alkaline metal niobium complex has the structure:

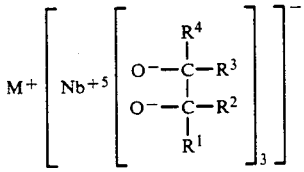

wherein M is an alkali metal selected from the group consisting of lithium, potassium, and sodium; R1 through R4 are independently selected from the group consisting of alkyl having 1 to 5 carbon atoms, alkoxy wherein the alkyl portion has from 1 to 5 carbon atoms, halogen such as fluorine, chlorine, bromine and iodine, cyano and nitro or R1 and R4 can be hydrogen and R2 and R3, taken together, can represent a saturated or unsaturated substituted or unsubstituted carbocyclic or heterocyclic ring structure containing from about 6 to 13 carbon and heteroatoms.

Complexes similar to those useful herein have been mentioned in the art but have not been used in a process for making niobates or tantalates. (Mehrota, Rai, Kapoor and Bohra; Organic Derivatives of Niobium(V) and Tantalum(V); Inorganica Chemica Acta 16 (1976) 237–267)

The alkaline metal niobium or tantalum complex can be made by methods which are known in the art. In a typical method, a niobium or tantalum complex of a monovalent ligand is mixed with a precursor of bidentate ligand. The ligands exchange and the niobium or tantalum complex is formed. An alkali metal complex is then added to a solution of the niobium or tantalum complex and the desired alkaline metal niobium or tantalum complex precipitates. This preparation is illustrated in the examples.

The alkaline metal niobium or tantalum complex is pyrolyzed to form desirable niobates or tantalates. Firing of the complex at between about 350° C. and 700° C. produces the desired result. This temperature is relatively low compared to, for example, the 1000° C. that is used in the process where mixed oxides are used as the precursor to the niobate or tantalate.

The niobate or tantalate that is made according to the method of the invention can be used in a variety of forms to produce desirable layers of the material. The niobates or tantalates can be used in liquid phase epitaxy, rf sputtering, laser ablation, e-beam evaporation, epitaxial growth by melting, and molecular beam epitaxy.

In one preferred method for forming a layer, the alkaline metal niobium or tantalum complex is dissolved in a solvent and this solvent solution is coated on a support to form a film. The film is then converted to the alkaline metal niobate or tantalate layer by pyrolysis of the coated film.

The concentration of the complex in the solution that is used to make the layers is not critical. Concentrations ranging from about 0.1 molar to about 5.0 molar are preferred and about 0.5 to 1.0 molar are more preferred. Concentrations of about 0.8 molar are particularly useful. If the concentration is too high, the coatings tend to crack after preparation. If the concentration is too low, the coatings tend to be too thin.

In accordance with certain embodiments of the invention, the alkaline metal niobium or tantalum complex is dissolved in a solvent. The choice of the particular solvent is not critical. Useful solvents include tetrahydrofuran (THF), dimethylformamide (DMF), methanol, ethanol, water and acetic acid.

Coating of the solution of complex is accomplished using known methods. Spin coating as is known in the art is particularly convenient.

After the alkaline metal niobate or tantalate complex is coated on the support, it can be pyrolyzed to form the desired alkaline metal niobate or tantalate. Other forms, in addition to optical waveguide layers, are also useful. For example, the niobate or tantalate complex can be dissolved in a solvent and converted to a useful powder by spray pyrolysis.

The following examples are presented for a further understanding of the invention.

EXAMPLE 1

Niobium pentachloride (3.0 g) and catechol (3.7 g) were mixed in 200 mL of dry toluene and refluxed overnight. A red precipitate was filtered from the solution, washed with toluene and dried. The dried complex (2.0 g) was dissolved in dry tetrahydrofuran (THF) under argon. n-Butyl lithium (1.6 mL of a 2.5M solution in hexane) was added. The solution turned dark red immediately. Solid precipitated a few minutes later and the mixture was stirred for one hour at room temperature. The fine solids were filtered and dried under vacuum. Analytical analysis confirmed the following compound:

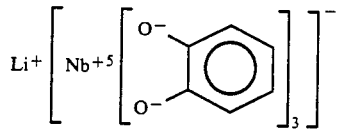

This lithium niobium catecholate was heated at 650 ° C. for 30 minutes. The x-ray diffraction analysis of the product matched that of lithium niobate.

EXAMPLE 2

Niobium pentaethoxide (2.66 g) and pinacol (2.97 g) were heated in 150 mL of toluene under argon overnight. After cooling, the precipitate was collected by filtration and washed with ether. The powder (2.0 g) was dissolved in dry THF (80 mL) under argon. n-Butyl lithium (2.66 mL of a 1.7M solution in hexane) was added. The solution was stirred overnight and concentrated. The product was collected by filtration and dried. Analytical analysis confirmed the following compound:

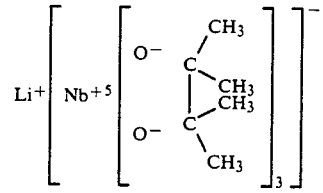

This alkaline metal niobium complex was heated at 10° C./min to 500° C. in air and held at 500° C. for 30 minutes. The x-ray diffraction pattern of the product matched that of lithium niobate.

EXAMPLE 3

The alkaline metal niobium complex formed in Example 2 (0.07 g) was dissolved in acetic acid (0.2 mL) in air and spin coated over a sapphire support at 1500 rpm. The resulting film was pyrolyzed at 400° C. for 10 min. The resulting layer was 0.3 microns thick and transparent. The x-ray diffraction pattern of the layer matched that of lithium niobate.

The present invention has been described with reference to particularly preferred embodiments thereof. However, it will be understood that modifications and extensions can be effected within the spirit and scope of the invention.

What is claimed is:

1. A method for making an alkali metal niobate or tantalate, said method comprising the steps of:

a) forming a salt of an alkali metal and a monovalent niobium or tantalum containing complex, said complex comprising niobium or tantalum complexed with three bidentate ligands or two tridentate ligands; and b) pyrolyzing said salt so as to form said alkali metal niobate or tantalate.

2. A method according to claim 1 wherein said salt has the structure:

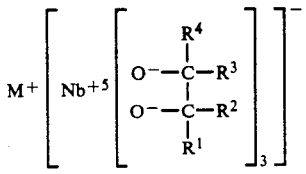

wherein M is an alkali metal selected from the group consisting of lithium, potassium, and sodium; R1 through R4 are independently selected from the group consisting of alkyl having 1 to 5 carbon atoms, alkoxy wherein the alkyl portion has from 1 to 5 carbon atoms, halogen such as fluorine, chlorine, bromine and iodine, cyano and nitro or R1 and R4 can be hydrogen and R2 and R3, taken together, can represent a saturated or unsaturated substituted or unsubstituted carbocyclic or heterocyclic ring structure containing from about 6 to 13 carbon and heteroatoms.

3. A method according to claim 1 wherein said salt has the structure:

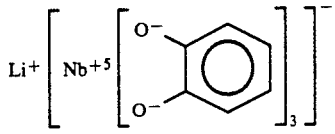

4. A method according to claim 1 wherein said salt has the structure:

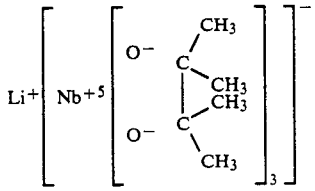

5. A method of forming a layer of an alkali metal niobate or tantalate, said method comprising the steps of:

a) coating a solution of a salt of an alkali metal and a monovalent niobium or tantalum containing complex on a support, said complex comprising niobium or tantalum complexed with three bidentate ligands or two tridentate ligands; and b) pyrolyzing said salt so as to form said alkali metal niobate or tantalate layer.

* * * * *